United States Patent [19]

Bolton et al.

[11] Patent Number: 4,480,533

[45] Date of Patent: Nov. 6, 1984

[54] CONTROL FOR VENT DOOR

[75] Inventors: Theodore S. Bolton; James E. Napolitano; Bruce T. Banner, all of Liverpool, N.Y.

[73] Assignee: Carrier Corporation, Syracuse, N.Y.

[21] Appl. No.: 518,706

[22] Filed: Jul. 29, 1983

[51] Int. Cl.[3] ..... F24F 1/02

[52] U.S. Cl. ..... 98/38 B; 98/38 D; 165/24; 165/54; 165/96

[58] Field of Search ..... 98/38; 165/24, 25, 54, 165/96; 237/12.3 A, 12.3 B

[56] References Cited

U.S. PATENT DOCUMENTS 1,777,848 10/1930 Harnett ..... 98/38 E
2,822,820 2/1958 Samuelsson ..... 165/96 X
2,828,110 3/1958 Baker et al. ..... 98/38 E X
3,299,796 1/1967 Toper et al. ..... 98/38 E

*Primary Examiner*—Harold Joyce
*Attorney, Agent, or Firm*—Thomas J. Wall

[57] ABSTRACT

A vent door control apparatus for use in an air conditioner that permits both manual and automatic positioning of the vent door. A series of push button function switches are arranged to move in contact with a series of cams to automatically unlatch the door when certain functions are selected. At least some of the cams are programable to permit the user to select which functions will be carried out without adding outside air to the conditioned air. The vent door can be further manually operated to open the door anytime an unprogramed function is selected.

10 Claims, 6 Drawing Figures

CONTROL FOR VENT DOOR

BACKGROUND OF THE INVENTION

This invention relates generally to air conditioning and, in particular, to apparatus for controlling the positioning of a vent door for supplying outside air to the mixing chamber of an air conditioning unit.

Although the present invention can be used in association with a wide range of air conditioning units, it is particularly well suited for use in conjunction with a package terminal air conditioning unit (PTAC). Package terminal air conditioners are generally free standing, low profile inside units, that are positioned against an outside facing wall of a building, typically under a window or a set of windows, which serves to condition air within a defined region such as a room or an office. This type of unit, because of its ease of installation and operational flexibility, has found a wide range of applications in many types of buildings such as office buildings, apartment houses, homes, motels and hotels.

The PTAC unit conventionally contains a concealed control panel having a series of push button function switches by which an occupant can select one of a number of heating and/or cooling modes of operation. A vent door which, when opened, allows outside air to be passed into a chamber where it is mixed with conditioned air. The control and positioning of the vent door has been a problem in many of these units for various reasons.

In some PTAC units the door is positioned manually. The occupant-user, when he or she deems it necessary, will open the door to allow outside air to enter the unit regardless of the selected mode of operation. Oftentimes, the door is forgotten when the operational mode is changed and the door will remain open when outside air is no longer required. By the same token, the door may be left closed when outside air is highly desirable for efficient operation of the unit.

In other PTAC units the operation of the vent door is tied to the operational mode that is selected without regard for outside or inside conditions. For example, during extremely cold weather the door may be opened when heat is called for by the unit. Mixing of this extremely cold air outside air with the warmer indoor air forces the unit to work extremely hard in order to meet the heating demands. Under certain conditions these demands cannot be met whereupon the unit will be forced to work continually until such time as the outdoor temperatures moderate. Clearly, this procedure is wasteful in terms of energy consumption and could be avoided if further control was provided over the venting operation. The same is true on extremely hot days. Here the vent may be open when a cooling mode of operation is selected and remain open despite the load placed on the unit in cooling the added outside air.

SUMMARY OF THE INVENTION

It is therefore an object of this invention to improve air conditioning units of the type wherein outside air is selectively mixed with conditioned air.

A further object of the present invention is to improve package terminal air conditioners.

A still further object is to provide an air conditioning unit having push button function control switches with the capability of automatically closing the vent door when selected function switches are depressed.

Another object of the present invention is to provide a vent door control for use in an air conditioning unit that can be set to close the door automatically when selected function switches are depressed and which will also allow for manually closing of the door at any time.

Yet a further object of the present invention is to save energy by limiting the amount of outside air that is mixed with conditioned air as the conditioned air is moved through an air conditioning unit.

Another object of the present invention is to provide the user of a package terminal air conditioner unit the ability to program the unit to automatically close the vent door of the unit when certain selected function switches are actuated.

While yet another object of the present invention is to insure that the vent door of a package terminal air conditioner unit is securely closed any time the unit is placed in an off condition.

These and other objects of the present invention are attained by means of an air conditioning unit having a control panel containing a series of push button function switches and a vent door for bringing outside air into the mixing chamber of the unit, the unit further including a biasing spring for urging the vent door into a normally closed condition, a manual operated rotor on the control panel for selectively positioning the door in either an open or a closed position, a latch for locking the rotor in a door opening position and a release mechanism that is responsive to at least one of the function switches for unlocking the latched rotor, and thus automatically closing the vent door, when at least one switch is depressed.

BRIEF DESCRIPTION OF THE DRAWINGS

For a better understanding of these and other objects of the present invention reference is had to the following detailed description of the invention which is to be read in conjunction with the accompanying drawings, wherein.

DESCRIPTION OF THE INVENTION

Figure 1:
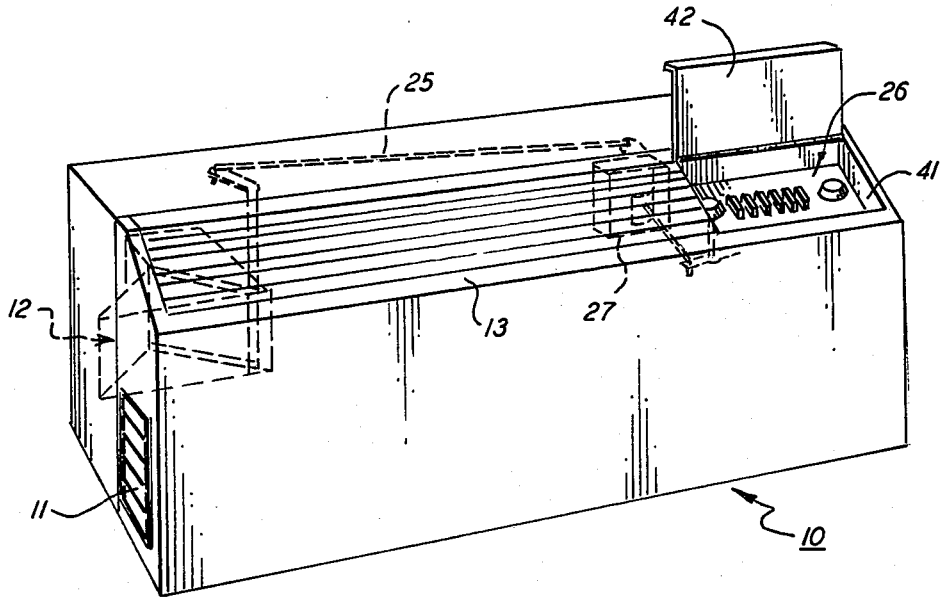
FIG. 1 is a perspective view of a package terminal air conditioner unit embodying the teachings of the present invention.

Referring now to the drawings and, in particular, to FIG. 1, there is shown a package terminal air conditioner (PTAC), generally referenced 10, that is capable of delivering both heating and cooling to an air conditioned region. Indoor air is brought into the unit by means of an inlet duct 11 located in the side wall of the unit. A blower (not shown) draws the indoor air through a mixing chamber where it can be mixed with outside air brought into the unit via a vent door assembly 12. The blower then moves the air over a series of heat exchangers to either heat or cool the air prior to its being discharged into the conditioned region through louvered outlet duct 13. In light of the fact that this type of air handling equipment is well known and widely used in the art, the equipment will not be explained in further detail herein.

Figure 6:
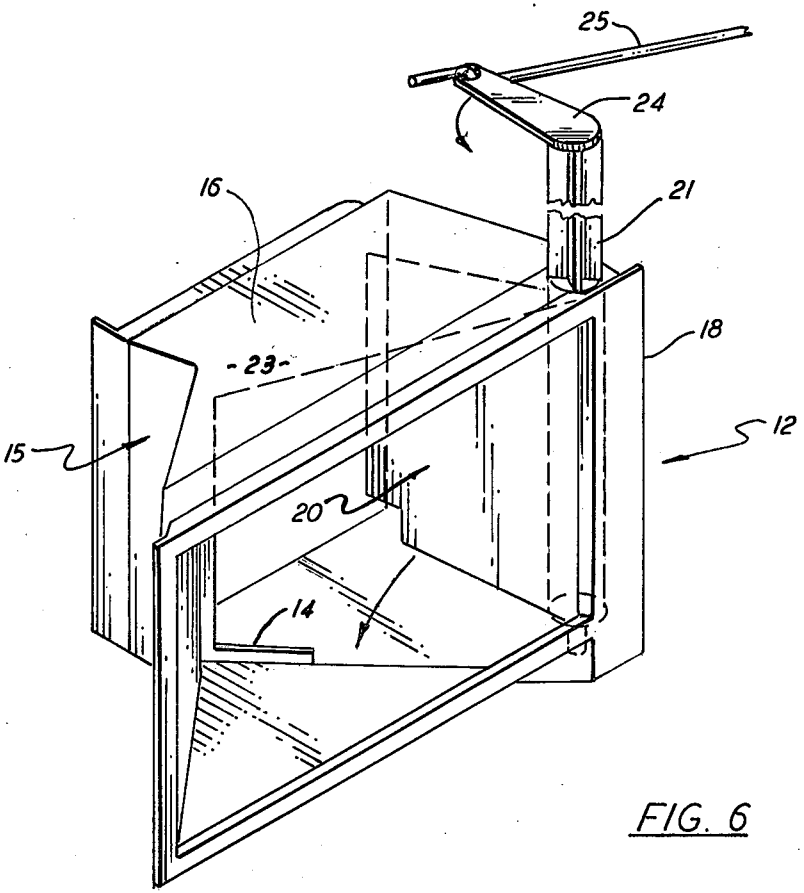
FIG. 6 is also an enlarged view in perspective of the vent door assembly used in the present invention.

The PTAC unit is generally located within the air conditioned region against an outside facing wall to provide close access to a supply of outside air. As noted, outside air is brought into the unit through a vent door assembly 12. As shown in FIG. 6, the assembly includes a housing 15 having an enlarged front opening that is joined to a rectangular shaped duct 16 to provide a passage through which outside air may be delivered into the air mixing chamber of the unit. The enlarged front opening of the door assembly is framed by a mounting flange 18 which is secured by any suitable means about an opening formed in the back wall of the mixing chamber to form an airtight joint therebetween. The duct 16 passes outwardly through the rear of the unit and is received in an opening in the outside wall of the building.

A door 20 is pivotably mounted within the vent enclosure by means of an elongated hinge 21. The door is permitted to swing about the hinge between a fully closed position wherein it abuts stop surface 14 and a fully opened position as shown in FIG. 6 wherein the door abuts sidewall 22 of the duct. The hinge extends upwardly from the top wall 23 of the assembly and has a horizontally disposed arm 24 mounted at the terminal end thereof. The arm is attached to a connecting rod 25 which allows the door to be opened and closed from a remote location.

As illustrated in FIG. 1, the connecting rod passes laterally across the top of the unit and is coupled to the control panel 26 of the unit through means of a closure mechanism generally depicted at 27. As will be explained in greater detail below, the vent door, once opened, may be closed manually or automatically in a programmed response to the positioning of one or more push button function switches located on the control panel.

Figure 5:
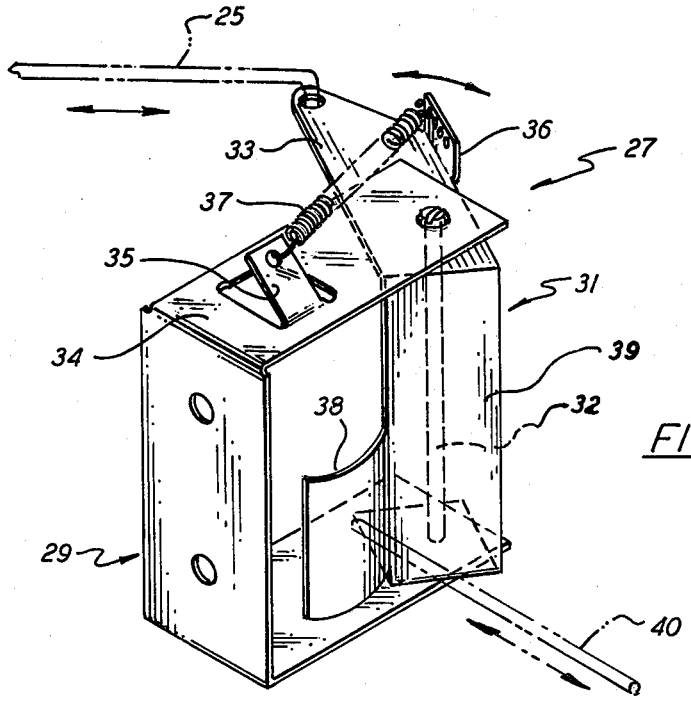
FIG. 5 is an enlarged view in perspective of the biasing mechanism for urging the vent door into a closed position.

The door closure mechanism 27, as best seen in FIG. 5, includes a C-shaped mounting bracket 29 that is secured by any suitable means to a panel 30 (FIG. 3) immediately behind the control panel. A rocker bar assembly 31 is rotatably suspended within the bracket by means of a pin 32. The top wall of the assembly extends outwardly to form a movable link 33 that is coupled to the connecting rod 25. A section of the upper arm 34 of the bracket is turned upwardly to form a tab 35 which anchors a biasing closure spring 37. The spring, in assembly, is mounted in a loaded condition between the tab and a raised mounting plate carried in the top wall of the rocker bar assembly. The spring acts through the linkage to pull the vent door into a normally closed position. An actuator 38 depends from the vertical sidewall 39 of the rocker bar assembly and is arranged to ride in sliding contact with a push rod 40.

Figure 2:
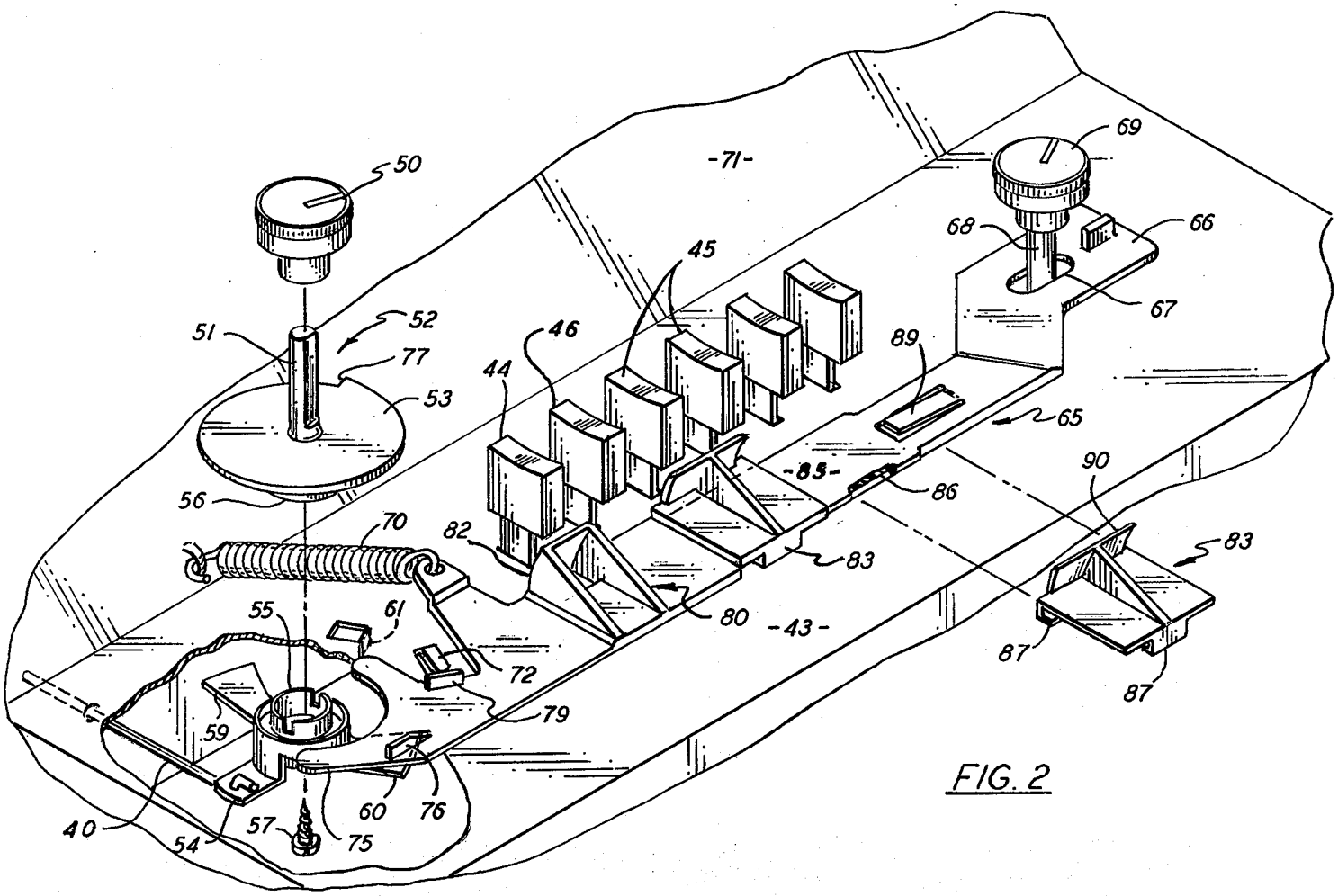
FIG. 2 is an enlarged view in perspective of the control panel utilized in the unit shown in FIG. 1.

The control panel 26 of the PTAC unit is contained within a recessed housing 41 (FIG. 1) located in the top of the unit. A hinged panel 42 provides access to the control panel. As illustrated in greater detail in FIG. 2, the control panel includes a base plate 43 upon which is mounted a series of laterally disposed push button function switches. Switch 44 is an on-off switch while remaining switches 45—45 relate to various cooling and heating operations and switch 46 relates to fan only operation. Depressing a selected one of the function switches locks the switch in a down position and through associated circuitry initiates the related function. Simultaneously therewith, the previously selected function switch is unlocked and is raised to an up position. This type of push button arrangement is well known and widely used in many types of air conditioning units.

Positioned to one side of the function switch array is a vent door control knob 50 that can be turned clockwise to move the vent door to an open position against the biasing pressure of closure spring 37. The control knob is secured to the shaft 51 of a rotor assembly generally referenced 52. The assembly includes a latching disc 53 that overlies the top surface of the base plate and cylindrical arm 54 that is positioned beneath the plate. The arm is joined to the latching disc by means of a notched coupling 55 that is telescoped into a mating sleeve 56 that is secured to the bottom of the latching disc. The cojoined members are secured in assembly by a screw 57 so that the arm is caused to turn with the control knob 50.

Push rod 40 is attached to the cylindrical arm 54 of the vent door control knob assembly. A pair of radially disposed stop wings, 59,60 are secured to cylindrical arm assembly 55. The wings are arranged to move into arresting contact with an arresting flange 61 depending from base plate 43 to limit the rotational freedom of the knob assembly and thus the linear displacement of the push rod. The wings are positioned upon the assembly so that when wing 59 abuts the arresting flange the rod is displaced sufficiently to fully open the vent door. Conversely, when wing 60 is brought into abutting contact with the flange, the vent door will be permitted to be pulled by the biasing spring 37 into a fully closed direction.

A lever arm 65 is positioned upon the top surface of base plate 43. The proximal end 66 of the arm has a slotted hole 67 formed therein which is arranged to slidably receive a pivot 68 therein. The pivot, in this particular embodiment, is the shaft of a temperature control unit 69 located at the right side of the function switch array opposite the vent door control knob assembly. Through use of the slotted hole and pivot arrangement, the arm is free to both rotate about the pivot and to slide laterally along a path of travel that is parallel with the function switch array. A locking spring 70 is adapted to act between backplate 71 of the control panel and the lever arm to pull the arm in a clockwise direction about the pivot. A stop 72 mounted upon the top surface of the base plate is positioned to intercept the arm and limit the amount of rotational movement afforded the arm.

Figure 3:
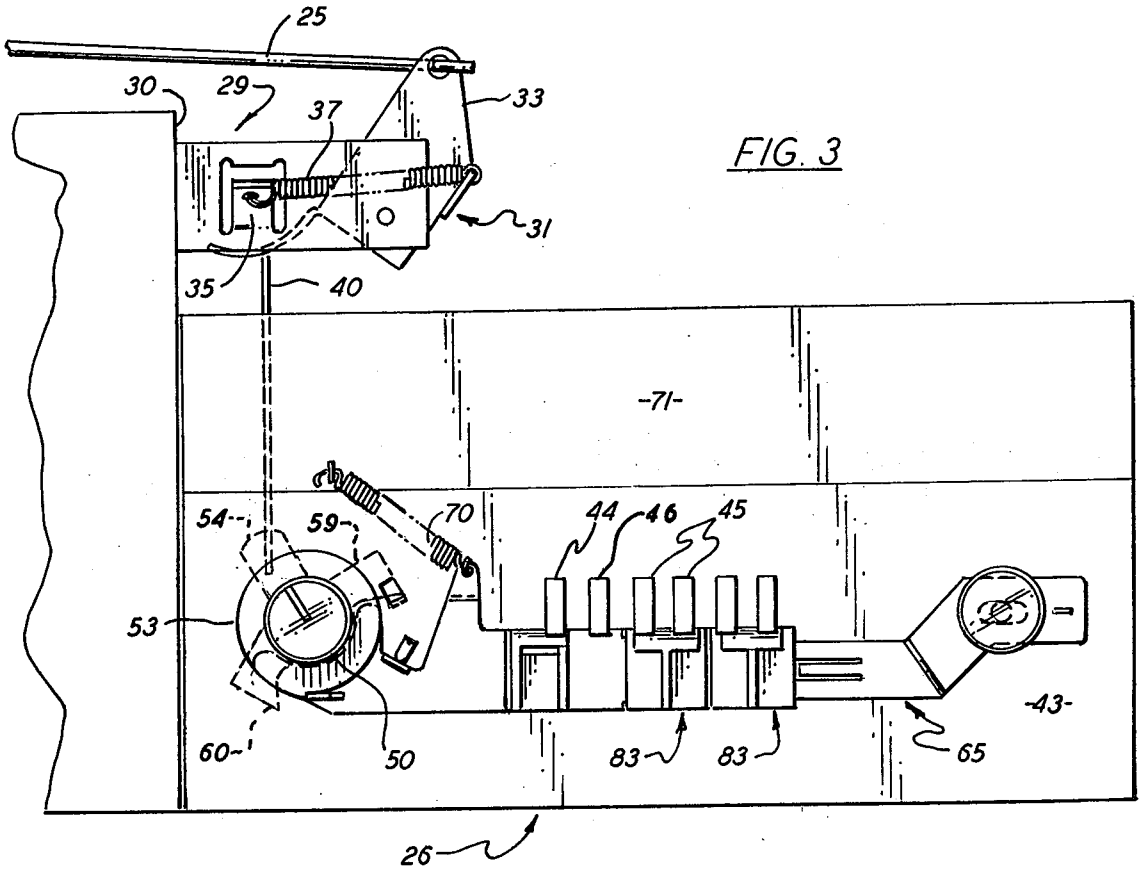
FIG. 3 is a partial top view of the control panel and the control linkage for activating the vent door employed in the present unit showing the linkage in a door closing position.
Figure 4:
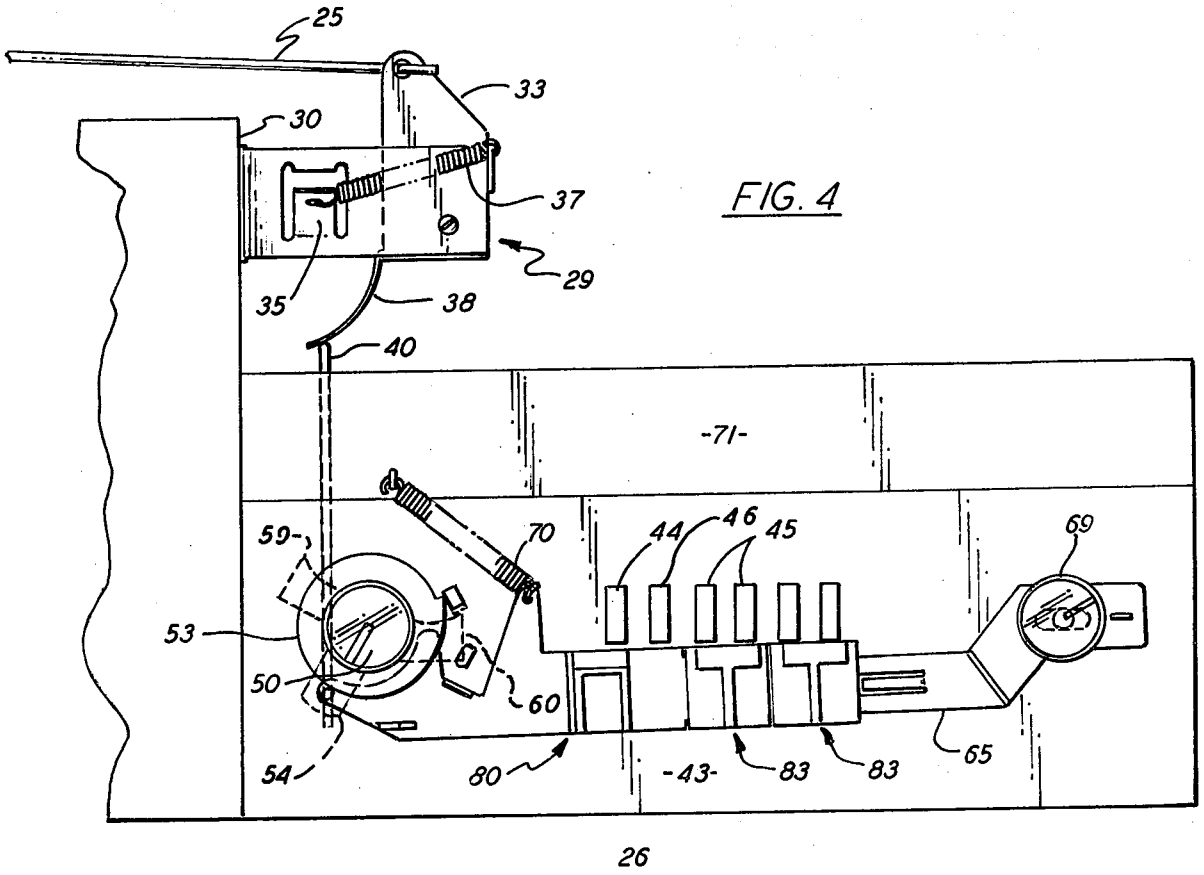
FIG. 4 is a partial top view of the control panel and control linkage shown in FIG. 3 illustrating the linkage in a door opening position.

The distal end 75 of the lever arm is formed into an arcuate shaped bifurcation which, in assembly, passes beneath the latching disc of the vent door control knob assembly to prevent the arm from being raised vertically from the base plate of the control panel. A raised dog 76 is secured to the top surface of the arm at the distal end thereof. The dog is adapted to engage a V-like notch 77 formed in the outer periphery of the latching disc 53 to lock the disc in a condition as shown in FIG. 3 for holding the door open.

The disc is locked in a door opening position by turning the knob 50 manually in a clockwise direction until the dog drops into the notch. The dog is locked in place by the action of locking spring 70. The door, once locked in an open position can be manually returned to a closed position by manually turning the knob in the opposite direction. At this time, the lever arm, rather than being rotated about pivot 68, is moved linearly past the pivot along the base plate by means of the slotted hole 67. A guide plate 79 on the distal end of the arm rides against the stop 72 and serves to direct the arm along the desired path of travel beneath the function switch. Spring 70 again biases the guide against the stop to insure that contact is maintained therebetween throughout the release or unlatching operation. Once the dog is free of the notch, the closure spring 37 takes over and the door is rapidly and automatically pulled into a closed position.

In addition to the manual closing of the vent door, the apparatus of the present invention also includes an automatic door closing feature that is initiated in response to the depression of one or more of the function switches. A permanent cam 80 is carried on the lever arm immediately below the on-off function switch 44. The permanent cam has a contoured working surface 82 thereon that contacts the function switch as it moves into the down or off position. The cam is arranged to rotate the lever arm sufficiently about the pivot to unlock the dog from the latching disc in the event the door is in an open position when the unit is turned off. Accordingly, the door will be immediately unlocked and pulled rapidly to the closed position any time the unit is inactivated.

A series of programable cams generally referenced 83—83 are also provided which can be slidably mounted upon the main body section 85 of the lever arm beneath the remaining function switches 45—45. The arm has a cut out 86 formed therein which enables the slide tabs 87—87 of the programable cams to be brought beneath the lever arm body. Once the tabs are located under the lever arm, the cam unit can be moved laterally beneath the function switches and positioned in juxtaposition to a selected one thereof. A locating surface 89 is provided to accurately locate the units in reference to the cut out to insure ease of installation and removal of the units.

For example, if the PTAC unit was to be used in a zone having harsh winters, it would be desirous to place one of the programable cams beneath a heat related switch. Anytime that heat is called for, i.e. the switch is depressed, the switch will contact working surface 90 on the cam causing the lever arm to be rotated automatically to an unlatching position thus insuring the vent door is closed when heat is called for. A second programable cam may also be similarly positioned beneath a cooling related function to automatically unlatch the door when cooling is called for.

As should be evident from the disclosure above, the apparatus of the present invention is ideally well suited for use in any type of air conditioning unit wherein outside air may at times be mixed with the conditioned air. The apparatus allows both manual and automatic control over the vent door so that the door cannot be left open when the unit is off or when selected heating and cooling operations are in progress. Furthermore, through use of the programable cam system the user can pre-program the unit at his option to control the vent door in a manner best designed to conserve energy.

While this invention has been described with reference to the structure disclosed herein, it is not confined to the details set forth and this application is intended to cover any modifications or changes as may come within the scope of the following claims.

We claim:

1. In an air conditioner unit having a vent door that is movable from a closed position to an open position to allow outside air to be mixed with conditioned air and a control panel having an align series of function switches that are individually depressed to initiate a selected function, the improvement comprising biasing means for resiliently urging the vent door into a closed position, manually actuated control means mounted on the control panel that is operatively connected to the vent door for moving the vent door from a closed position to an open position;

latching means associated with the control means for locking the vent door in the said open position against the action of the biasing means, and a release mechanism that is responsive to at least one of the said function switches for unlocking the latching means upon the depression of said at least one function switch whereby the vent door is allowed to move to the closed position under the influence of the biasing means.

2. The apparatus of claim 1 wherein the said at least one function switch includes an on-off switch that inactivates the unit when the switch is depressed.

3. The improvement of claim 1 wherein the release mechanism includes a rotatable bar having a spring means for holding the bar in engagement with the latching means and cam means for contacting the said at least one of the function switches and rotating the bar sufficiently to unlock the release mechanism when the said at least one function switch is depressed.

4. The improvement of claim 3 wherein the bar includes a slotted opening for receiving a pivot means therein to permit the bar to both rotate about the pivot and to move linearly to unlock the latching means whereby the latching means can also be unlocked by manually turning the control means to the door opening position.

5. The improvement of claim 3 wherein the lever bar includes a series of programmable cams that are removably mounted upon the bar to permit the cams to be positioned beneath selected function switches.

6. In a package terminal air conditioning unit for mixing outside air with conditioned indoor air, a vent door control apparatus that includes a vent door that is positionable between an open position and a closed position for bringing outside air into a mixing chamber where it is added to conditioned air, biasing means acting upon the door to urge the door into a normally closed position, a rotor means located on a control panel that is connected to the vent door by linkage means whereby the door is opened when the rotor means is turned to a first position and closed when it is turned to a second position, a pivot means located in the control panel opposite said rotor means, a switch means containing a series of push button function switches that are aligned between the rotor means and the pivot means, said function switches including an on-off switch which when depressed inactivates all other functions, a lever arm extending beneath the function switches between the rotor means and the pivot means, said arm having a slotted hole at its proximal end for slidably receiving the pivot means therein to permit the arm to both swing about the pivot and to slide along a path of travel that is generally parallel to the function switches, a stop means connected to the lever arm that is adapted to engage a complementary receiving groove contained in the rotor means when said rotor means is placed in the second position to lock the vent door in an open position against the action of the biasing means, and a camming means on the lever arm for engaging one of said function switches as it is depressed to move the arm out of locking engagement with the stop means thereby allowing the vent door to be closed by said biasing means.

7. The control apparatus of claim 6 wherein said camming means includes a permanent cam positioned on the lever arm beneath the on-off switch that has a working surface for riding in contact with said on-off switch to displace the lever arm sufficiently to unlock the rotor means when the on-off switch is depressed thereby allowing the vent door to close.

8. The control apparatus of claim 7 that further includes at least one other programmable cam that is removably positioned upon said arm beneath another said function switch, said programmable cam having a working surface that is adapted to contact another said function switch to displace the lever arm sufficiently to unlock the rotor means and allow the vent door to close when said another function switch is depressed.

9. The control apparatus of claim 6 that further includes a spring means acting upon said lever arm for holding the stop means in the receiving groove of the rotor means.

10. The control apparatus of claim 9 wherein said spring means is arranged to permit the lever arm to be both rotatably displaced by said cam means and to be linearly displaced when the rotor means is turned manually between the door control positions.

* * * * *